US010017907B1

(12) United States Patent
Davis et al.

(10) Patent No.: US 10,017,907 B1
(45) Date of Patent: Jul. 10, 2018

(54) LEVELER BRUSH FOR ROAD CONSTRUCTION

(71) Applicant: GreensGroomer WorldWide Inc., Indianapolis, IN (US)

(72) Inventors: Michael E. Davis, Indianapolis, IN (US); James Richard Hanson, Ft. Wayne, IN (US)

(73) Assignee: GreensGroomer WorldWide Inc., Indianapolis, IN (US)

( * ) Notice: Subject to any disclaimer, the term of this patent is extended or adjusted under 35 U.S.C. 154(b) by 0 days.

(21) Appl. No.: 15/707,149

(22) Filed: Sep. 18, 2017

Related U.S. Application Data

(63) Continuation-in-part of application No. 15/626,456, filed on Jun. 19, 2017.

(51) Int. Cl.

| | |
|---|---|
| ***E01C 19/00*** | (2006.01) |
| ***E01C 23/22*** | (2006.01) |
| ***E01C 19/17*** | (2006.01) |
| ***E02F 3/76*** | (2006.01) |
| *E01C 19/42* | (2006.01) |

(52) U.S. Cl.
CPC ..... *E01C 23/225* (2013.01); *E01C 19/178* (2013.01); *E02F 3/7663* (2013.01); *E01C 19/42* (2013.01)

(58) Field of Classification Search
CPC ..... E01C 19/42; E01C 19/178; E01C 23/225; E02F 3/7663
USPC ..... 404/83, 101, 110, 111
See application file for complete search history.

(56) References Cited

U.S. PATENT DOCUMENTS

| | | | | |
|---|---|---|---|---|
| 2,142,262 | A | 1/1939 | Beckham et al. | |
| 2,184,913 | A | 12/1939 | Fuller | |
| 4,315,700 | A * | 2/1982 | Heiligtag | E01C 19/174 172/439 |
| 4,688,964 | A * | 8/1987 | Cox | E01C 19/16 15/98 |
| 4,917,533 | A * | 4/1990 | Wilson | E01C 11/005 118/108 |
| 5,362,178 | A | 11/1994 | Schantz | |
| 5,765,963 | A * | 6/1998 | Roberts | E01C 19/16 404/101 |
| 5,833,013 | A | 11/1998 | Davis | |
| 6,102,615 | A | 8/2000 | Wilson, Sr. | |
| 6,655,469 | B1 | 12/2003 | Davis | |
| 8,220,558 | B2 | 7/2012 | Davis | |
| 9,179,588 | B2 | 11/2015 | Davis et al. | |
| 9,668,397 | B2 | 6/2017 | Davis | |
| 2010/0158608 | A1* | 6/2010 | Wilson, Sr. | C04B 24/2641 404/75 |
| 2017/0328028 | A1 | 11/2017 | Chern | |

* cited by examiner

*Primary Examiner* — Raymond W Addie
(74) *Attorney, Agent, or Firm* — Woodard, Emhardt, Moriarty, McNett & Henry LLP

(57) ABSTRACT

A device movable across a road to level emulsion thereon. A wheeled frame includes brushes extending downward to engage the emulsion. A manual worm gear connected between the frame and a towbar assembly positions the towbar mount to connect to a vehicle hitch and vertically moves the frame while maintaining the brush contacting plane. Spring biased guide wheels position the brushes to contact the road surface even though the surface is uneven.

12 Claims, 9 Drawing Sheets

LEVELER BRUSH FOR ROAD CONSTRUCTION

BACKGROUND OF THE INVENTION

Field of the Invention

The present invention relates generally to the field of vehicles or carriers movable across roads for the working of the upper surface thereof.

Description of the Prior Art

The maintenance of old asphalt roads can include spraying an emulsion on the top surface of the road. Aggregate may then be dropped onto the emulsion with the aggregate sinking below the top surface of the emulsion. Asphalt roads particularly those in the rural area may not be adequately maintained thereby increasing the deteriation.

A crown may run along the center of the road providing higher elevation in the middle as contrasted to the sides of the road. Further, the road may be undulating and uneven across the width and length thereof. Nevertheless, the emulsion must be evenly applied resulting in a smooth surface. The emulsion could be spread across the road either manually by brushes, scrapers or other devices. Alternatively, a frame with scrapers extending downwardly may be pulled behind a truck in order to attempt to achieve an even surface. It becomes difficult to achieve an even surface due to the varying elevation and deterioration of the road. Disclosed herein is a wheeled frame pullable behind a truck or other vehicle with the frame having downwardly extending brushes that are initially adjusted relative to the road surface as well as being adjusted as the frame is pulled along the road to ensure the brushes contact the emulsion in such a manner to achieve an even top surface. Substantial savings are achieved using the above technique since the life of the road is prolonged and therefore not requiring construction of a new road.

In our U.S. Pat. No. 9,179,588 we disclose a towable vehicle having downwardly extending brushes for brushing top dressing material between grass blades for the proper maintenance of golf greens. A variety of different brush patterns extending down from the vehicle are disclosed. The U.S. Pat. Nos. 5,833,013; 6,655,469; 8,220,558; and 9,668,397 granted to the co-inventor Michael E. Davis also disclose various vehicles or frames movable across the ground having ground engaging elements.

Early road working machines were disclosed in the U.S. Pat. No. 2,142,262 W K Beckham et al. and U.S. Pat. No. 2,184,913 C G Fuller. Both patents disclose leveling blades or scrapers extending downwardly from a frame to engage the road.

The main disadvantage of the prior devices is the inability to easily and quickly adjust the devices extending downwardly to contact the emulsion as the road undulates and may result in a very uneven upwardly extending road surface. The device disclosed herein allows for an initial setting and continued adjustment of the positioning of the downwardly extending brushes depending upon the contour of the road surface. Further, the brush frame elevation may be remotely controlled by a transmitter/receiver combination.

The brush frame includes a towbar pivotally mounted thereto that is connectable to the pulling vehicle hitch. The hitch may vary in height from each vehicle to each vehicle.

A mechanism is provided to position the towbar onto the hitch while maintaining the set plane of the brush frame.

Typically road working machines are transported to the working site by a flatbed vehicle. As the frame of the road working machine is pulled upwardly to store on a flat bed, the frame is traditionally tilted causing the rear portion of the frame to contact the ground with other portions of the frame contacting the top edge of the ramp as it is pulled onto the bed. The mechanism allows the brush frame to extend horizontally while the device is pulled from ground level up the ramp eliminating the prior problem of contact between the frame and the ground and/or the top of the ramp.

When pulling a road working machine along a road, particularly if the road has a crown, it becomes difficult to move the machine in a straight line if the ground engaging wheels are near the center axis of movement. Thus, the preferred embodiment disclosed herein has guide wheels located at the outer side extremities of the machine thereby minimizing any drift of the machine from the intended center axis of movement. Further, the guide wheels support at least a portion of the weight of the machine reducing downward force applied to the ground engaging brushes prolonging brush life and reducing brush maintenance.

SUMMARY OF THE INVENTION

One embodiment of the present invention is a device for spreading and leveling emulsion applied to a road surface and comprising a frame having a longitudinal axis of movement. A towbar is pivotally mounted to the forward portion of the frame. Wheels are mounted to the frame with the axis extending therebetween. Brushes are mounted to the frame and extend transversely across the axis of movement and extend downwardly to spread and level the emulsion applied to the road surface. Guide wheels are mounted to the frame and limit side drift of the frame as it moves forward while reducing downward force on the brushes.

It is an object of the present invention to provide a device for spreading and leveling emulsion applied to a road surface.

A further object of the present invention is to provide a new and improved road working device.

Yet a further object of the present invention is to provide a brush frame for leveling and spreading materials atop the ground.

Another object of the present invention is to provide means for limiting side drift of the road working device.

Related object and advantages of the present invention will be apparent from the following description.

DESCRIPTION OF THE PREFERRED EMBODIMENTS

Figure 1:
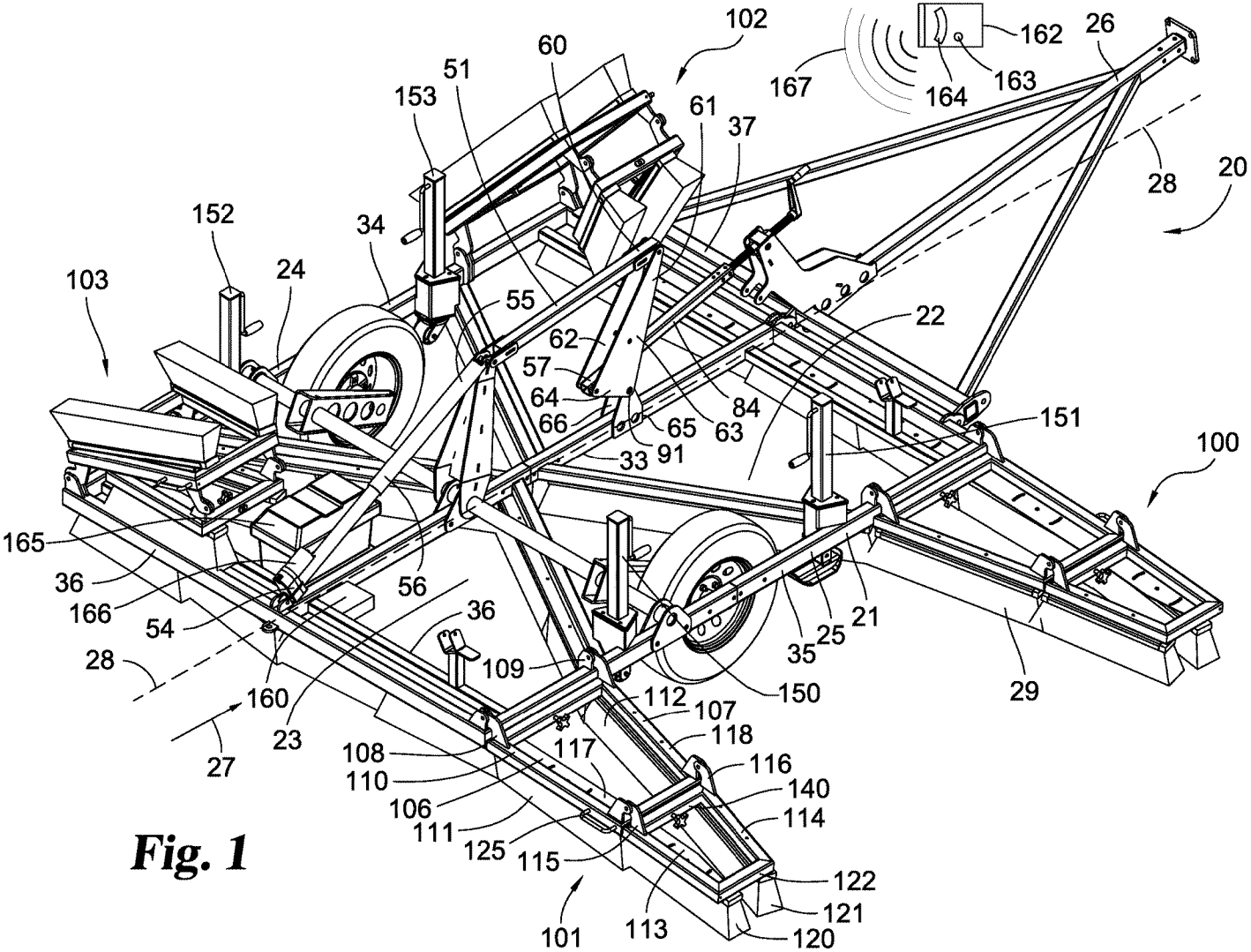
FIG. 1 is a rear perspective view of the spreading and leveling device incorporating an alternative embodiment of the present invention with some of the brushes of the device mounted to wings being folded upwardly to a stored position.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
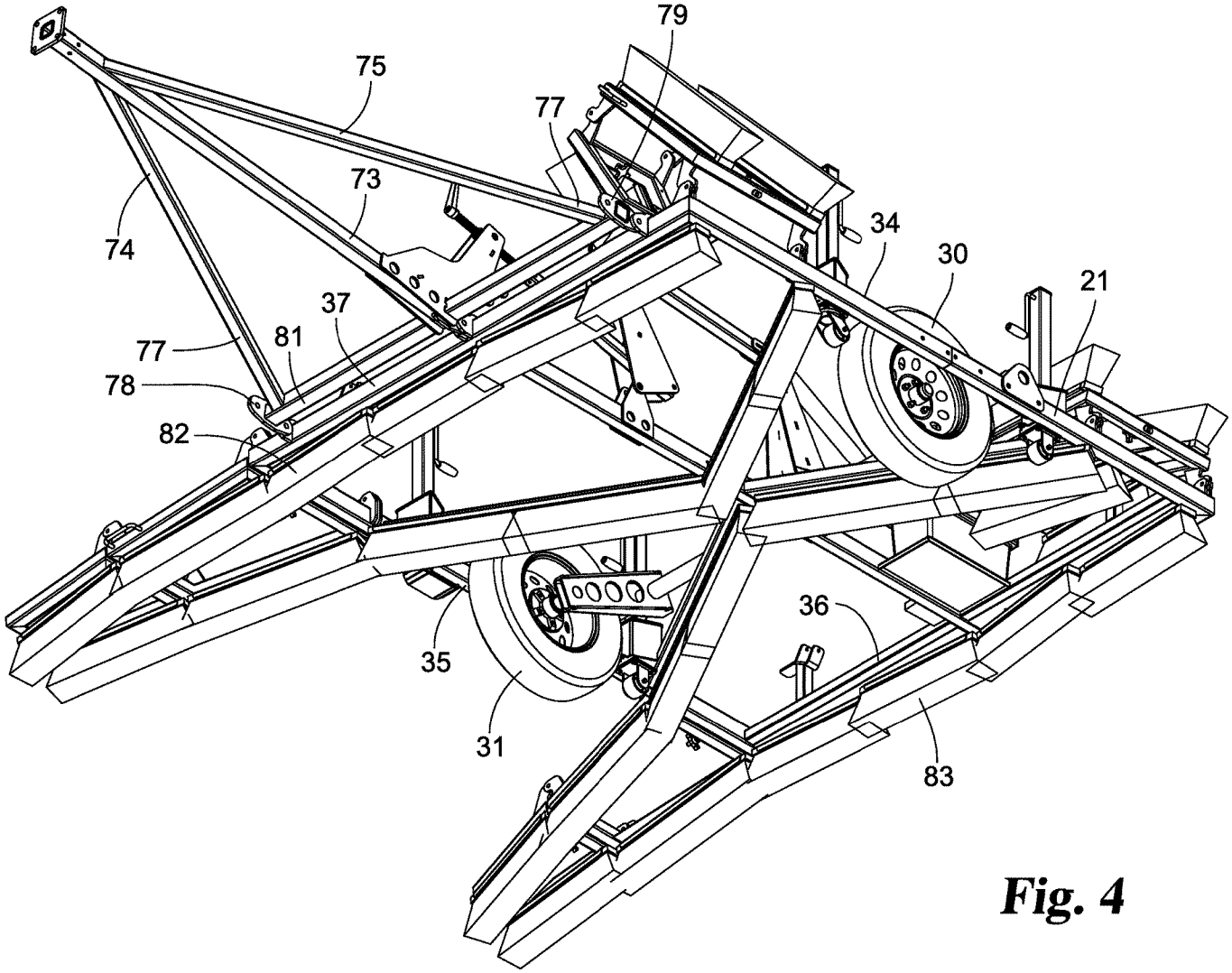
FIG. 4 is a bottom perspective view showing the upward stored brushes and downward in use brushes depending from the brush frame.

Referring to FIG. 1, an alternative embodiment of the present embodiment is shown as a device 20 for spreading and leveling emulsion applied to a road surface with the device including a rectangular frame 21 having a front portion 22 and back portion 23 along with a pair of parallel sides 24 and 25. Frame 21 includes side rails 34 (FIG. 4) and 35 having opposite ends attached to front rail assembly 37 and rear rail assembly 36 forming the rectangular configuration of the frame.

A towbar assembly 26 is pivotally mounted to the front end portion 22 of the frame to enable the towbar to be connected to a truck or other vehicle and pulled in the direction of arrow 27 (FIG. 2) along the longitudinal central axis of movement 28 (FIG. 1). The towbar is pivotable to position its distal end between a position higher than frame 21 to a position lower than frame 21.

A plurality of brushes 29 extend downwardly from the frame to engage the emulsion atop the load surface. The brushes extend transversely across axis 28 and spread and level the emulsion as the frame is moved forward. The brushes mounted to and beneath the front rail 37 and rear rail 36 extend perpendicularly to axis 28 whereas some of the remaining brushes extend from one diagonal corner of frame toward the opposite diagonal corner of frame 21.

Wheels 30 and 31 (FIG. 2) are rotatably mounted to brackets, in turn, fixedly secured to an axle 32 rotatably mounted to the centrally extending frame number 33 having its opposite ends connected to the frame. The wheels may be pivoted downwardly to support the frame thereby spacing the brushes apart from the road surface facilitating transportation of the device by another vehicle. Likewise, the wheels can be moved upwardly to not contact the road surface thereby allowing the bottom ends of the brushes to contact the emulsion atop the road surface.

Figure 2:
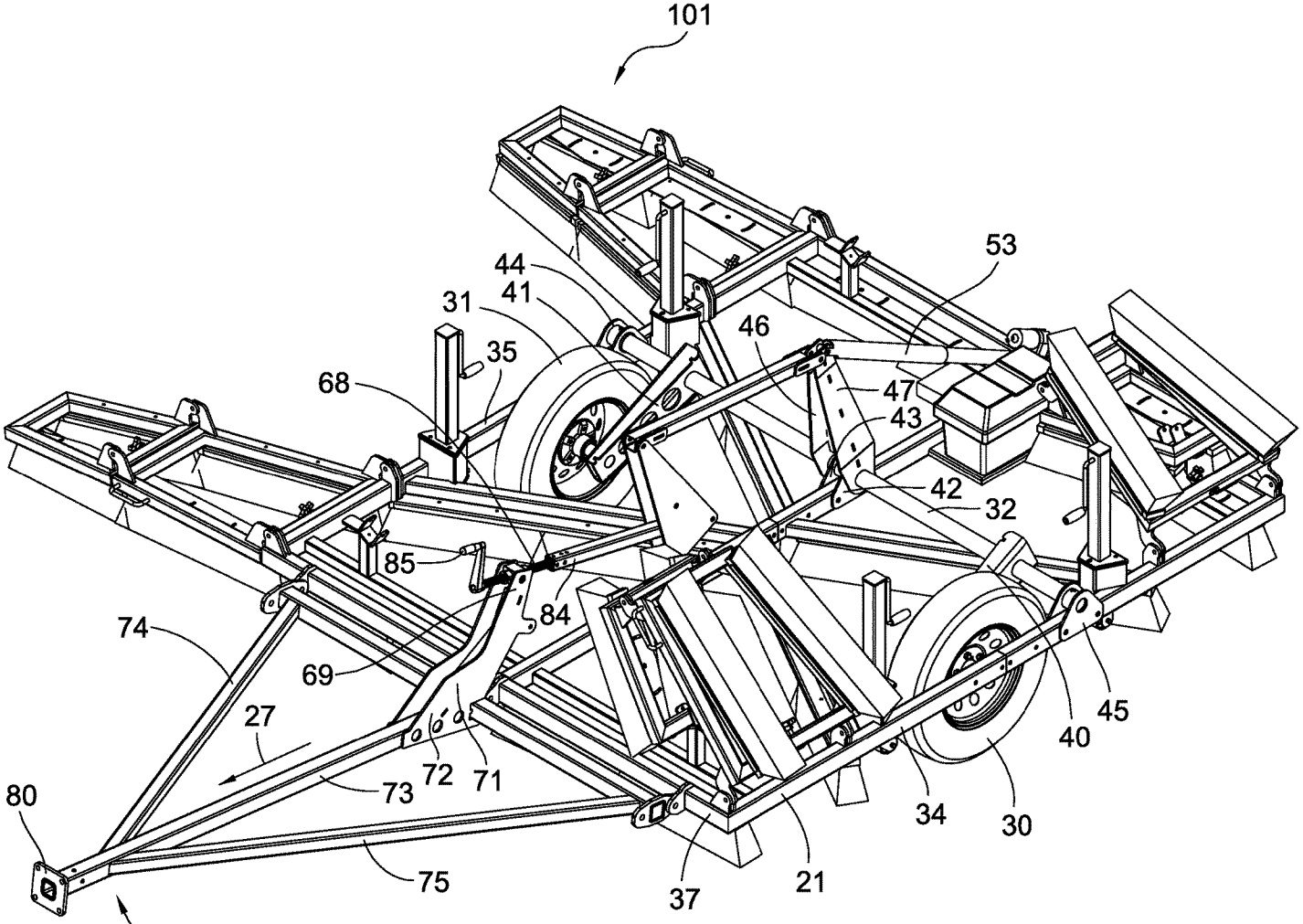
FIG. 2 is a front perspective view of the device of FIG. 1.

Wheels 30 and 31 are rotatably mounted respectively to members 40 and 41 (FIG. 2). Members 40 and 41 are, in turn, fixedly mounted to axle 32, in turn, rotatably mounted to a pair of brackets 42 and 43 fixedly secured to central rail 33, in turn, having its opposite ends fixedly mounted to front rail 37 and rear rail 36. Members 40 and 41 rotatably receive the wheels which are offset with respect to the axis of rotation of axle 32. The opposite ends of axle 32 (FIG. 2) are rotatably mounted by brackets 44 and 45 respectively to side rails 35 and 34. Further, axle 32 extends through and is rotatably mounted to brackets 42 and 43 fixedly mounted to the center rail 33.

Spaced apart members 46 and 47 have bottom ends fixedly mounted to axle 32 and move when axle 32 rotates thereby pivoting members 46 and 47 about their bottom ends. The top ends of members 46 and 47 are fixedly secured together and, in turn, are pivotally secured to rearward portion of cross link 51 (FIG. 1). Thus, forward movement of cross link 51 in the direction of arrow 27 causes counterclockwise rotation of the axle and members 46 and 47, as viewed in FIG. 2, about the longitudinal axis of axle 32. The counterclockwise movement, as viewed in FIG. 2, of members 46 and 47 thereby cause members 41 and 40 to pivot downwardly moving the wheels below the frame and brushes depending therefrom supporting the brush frame above the ground and preventing any contact between the brushes and the top surface of the road surface or ground.

A linear actuator 53 (FIG. 2) has a bottom end 54 (FIG. 1) pivotally mounted to rear rail assembly 36 and a top end 55 pivotally mounted to the junction connection of the top ends of members 46 and 47 to cross link 51. Linear actuators are well known in the industry and may include an electric motor for driving a worm gear within the casing of the actuator thereby causing the extension or retraction of the telescopically constructed casing. By actuating linear actuator 53, the casing 56 (FIG. 1) can be extended thereby causing members 46 and 47 to rotate in a clockwise direction, as viewed in FIG. 1, also causing clockwise rotation of axle 32 with the result wheels 30 and 31 pivoting to the downward position. In reverse, the linear actuator can be activated to shorten the length of casing 56 through the operation of the worm gear thereby causing members 46 and 47 to rotate in a counterclockwise direction as viewed in FIG. 1 causing counterclockwise direction of axle 32 and movement of wheels 30 and 31 to the upward stored position.

In order to provide for continuous adjustment of the brush contact with the emulsion atop the road, a commercially available receiver/transmitter combination is provided to remotely control the linear actuator. For example, a receiver 160 (FIG. 1) is mounted atop frame 21 and is connected to the motor 166 of the actuator. A 12 VDC transmitter 162 (FIG. 1) is located remotely from frame 21 and may be located in the vehicle pulling the frame 21 or carried by an operator walking beside the frame. The transmitter may be provided with an on/off switch 163 along with a switch 164 to control a signal 167 to the receiver for control of the rotation of the worm gear in the actuator. Examples of receiver/transmitter combinations are available from AmaMax (USA) located at 10700 Kinghurst St, Houston, Tex. 77099 under model iMBAPrice 12V, 15 Amps, Heavy Duty Boat and Car Universal Remote Control Kit or from PRI Industries, Inc. located at 714 Vandustrial Dr, Westmont, Ill. 60559 under model 20 AMP Heavy Duty 12 Volt on/off Wireless Remote Control Switch. Other receiver/transmitters are commercially available. A battery is contained in battery housing 165 mounted to frame and is electrically connected to the actuator and receiver.

The forward end 60 (FIG. 1) of cross link 51 is pivotally attached to the top ends 61 of upwardly extending members 62 and 63 having bottom ends pivotally mounted to a pair of brackets 65 and 66, in turn, fixedly secured to the center rail 33.

A manually operated worm gear 68 (FIG. 2) has a threaded shaft threaded received by the top end 69 of spaced apart brackets 71 having bottom ends 72 fixedly secured to the center rail 73 of towbar assembly 26. The forward end of the threaded shaft has a crank handle 85 thereon to facilitate rotation of the worm gear threadedly received by casing 84 having its opposite casing end 57 (FIG. 1) pivotally mounted to the bottom corners 64 of brackets 62 and 63. Corners 64 are located closer to the rear portion 23 of the frame as compared to the forward corner portion 91 of brackets 62 and 63. Thus, rotation of worm gear 68 causes the casing 84 to be extended or retracted relative to the crank handle 75. Rotation of worm gear in one direction results in extension of casing 74, with brackets 62 and 63 rotating in a counterclockwise direction about pivot forward corner 91 as viewed in FIG. 1 whereas rotation of the crank handle in the opposite direction causes movement of casing 84 in a direction toward crank handle 85 causing clockwise movement of bracket 62 and 64 as viewed in FIG. 1. When bracket 62 and 63 are rotated in a clockwise direction as viewed in FIG. 1, the top ends of brackets 62 and 63 cause cross link 51 to move forward in a forward direction (arrow 27) thereby also causing rotation of brackets 46 and 47 in a clockwise direction.

Figure 3:
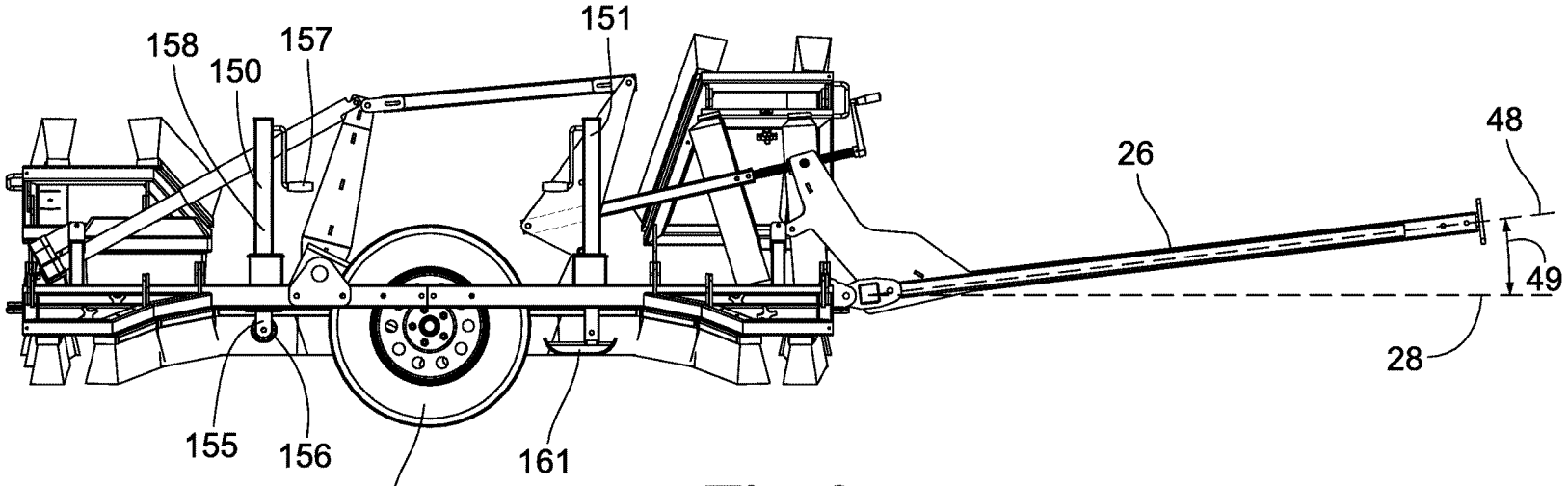
FIG. 3 is a side view of the device of FIG. 1 with the main wheels located in the road engaging position.

Towbar assembly 26 includes a central rail 73 (FIG. 4) bisecting the junction of rails 74 and 75 having their forward ends fixedly secured to the center rail 73. The rearwardly located ends 77 of rails 74 and 75 are fixedly connected to cross bar 81 in turn having opposite ends fixed mounted to flanges 78 and 79 pivotally mounted to the front rail 37 of frame 21. Thus, towbar assembly 26 may pivot upon its proximal ends positioning the longitudinal axis 48 (FIG. 3) of the towbar assembly relative to the longitudinal axis 28 of the frame a distance 49 and positioning the connector flange 80 for fastening to the truck hitch used to pull the vehicle frame device.

Downwardly extending brushes 82 (FIG. 4) are mounted to front rail 37. In addition, brushes 83 are mounted to the rear rail 36 with the brushes extending downwardly from rails 36 and 37 and extending across the width of frame 21 and in addition outwardly thereof being mounted to wings pivotally mounted to frame 21.

Four brush wings 100-103 (FIG. 1) are pivotally mounted to frame 21. In FIG. 2, wings 100 and 101 are shown in the downward position with the brushes attached thereto to engage the emulsion on the road surface, whereas wings 102 and 103 are shown in the upwardly stored position. Wings 102 and 103 are shown in the upward stored position simply to illustrate that the wings may be stored whereas both wings may be pivoted downward for the brushes attached thereto to engage the emulsion such as shown for wings 100 and 101. Likewise, wings 100 and 101 can be pivoted upward to the stored position as shown for wings 102 and 103.

Brush wing 101 will be now be described it being understood that a similar description applies to wings 100, 102, and 103. Wing 101 has rails 106 and 107 pivotally mounted by brackets 108 and 109 to frame 21. Bracket 108 pivotably mounts proximal end 110 of rail 106 to the front rail 36 whereas bracket 109 mounts the proximal end of wing rail 107 to side rail 35. Rails 106 and 107 have brushes 111 and 112 respectively mounted thereto which extend downwardly therefrom. The brushes may be removed by conventional fastening devices for replacement as needed. Wing rails 113 and 114 have their proximal ends attached respectively to brackets 115 and 116. The brackets, in turn, are mounted to the distal ends 117 and 118 respectively of rails 106 and 107. Brushes 120 and 121 are fixedly mounted to and extend downward from respectively rails 113 and 114. An end rail 122 joins the distal ends of rails 113 and 114 together with the rails 113 and 114 then extending divergently outward to the distal ends of rails 106 and 107. Rails 106 and 107 extend divergently outward from their distal ends towards their proximal ends 110. Thus, the wing frame composed of rails 106, 107, 113 and 114 has a generally V-shaped configuration with the outer portion of the wing consisting of rails 113 and 114 along with brushes 120 and 121 being pivotable relative to the inner portion of the wing frame formed by rails 106 and 107 which is also pivotable with respect to frame 21. A U-shaped handle 125 is fixedly secured to rail 106 to facilitate grasping and pivoting the wing upward.

Figure 5:
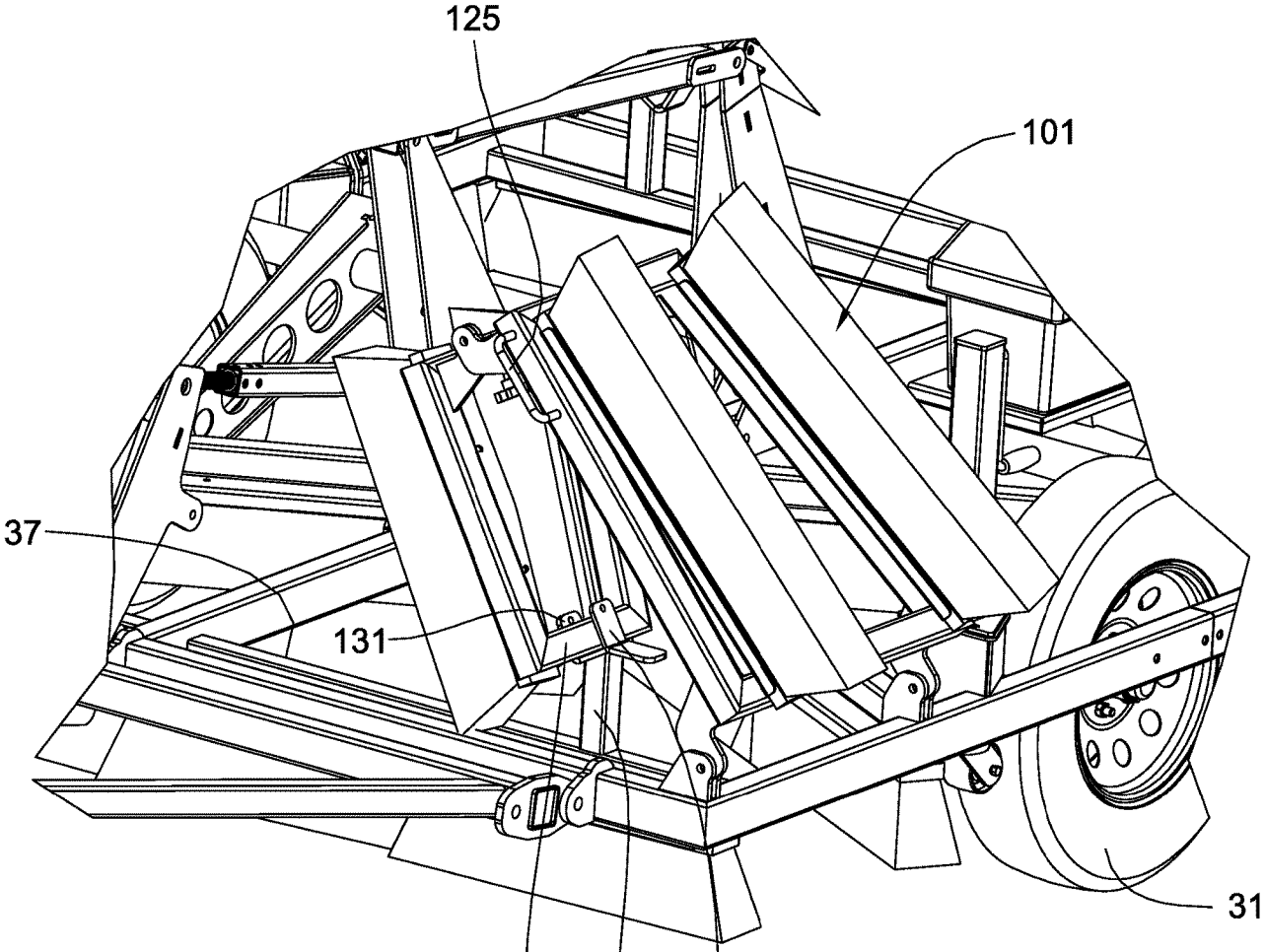
FIG. 5 is a fragmentary enlarged perspective of one of the wings and associated brush locked in the upward stored position.

Wing 101 is shown in the stored position in FIG. 5. In order to store wing 101, the outer portion of the wing including rails 113 and 114 are pivoted upward with respect to rails 106 and 107 eventually causing rails 106 and 107 to pivot about brackets 108 and 109. An upstanding arm 130 has a pair of spaced apart walls 131 and 132 sized and spaced apart to receive end rail 122 of the wing which may be removably pinned thereto. In such a position, both inner and outer portions of the wing along with their associated rails 106, 107, 113 and 114 and attached brushes are stored in an upward position apart from the road surface. Similar upstanding arms are provided for wings 100, 102, and 103. Thus, the other three brush wings 100, 102, and 103 may be stored in an upward position allowing the brush frame and associated components to be stored in a more compact space. Likewise, depending upon the width of the road surface, the wings may be pivoted downward from the stored position to extend outward from frame 21 to engage the road surface. The brush wings on one side of the wing frame may be stored in the upward position while the remaining two brush wings on the opposite side of the wing frame may be located in the downward road engaging position and vice versa.

Figure 6:
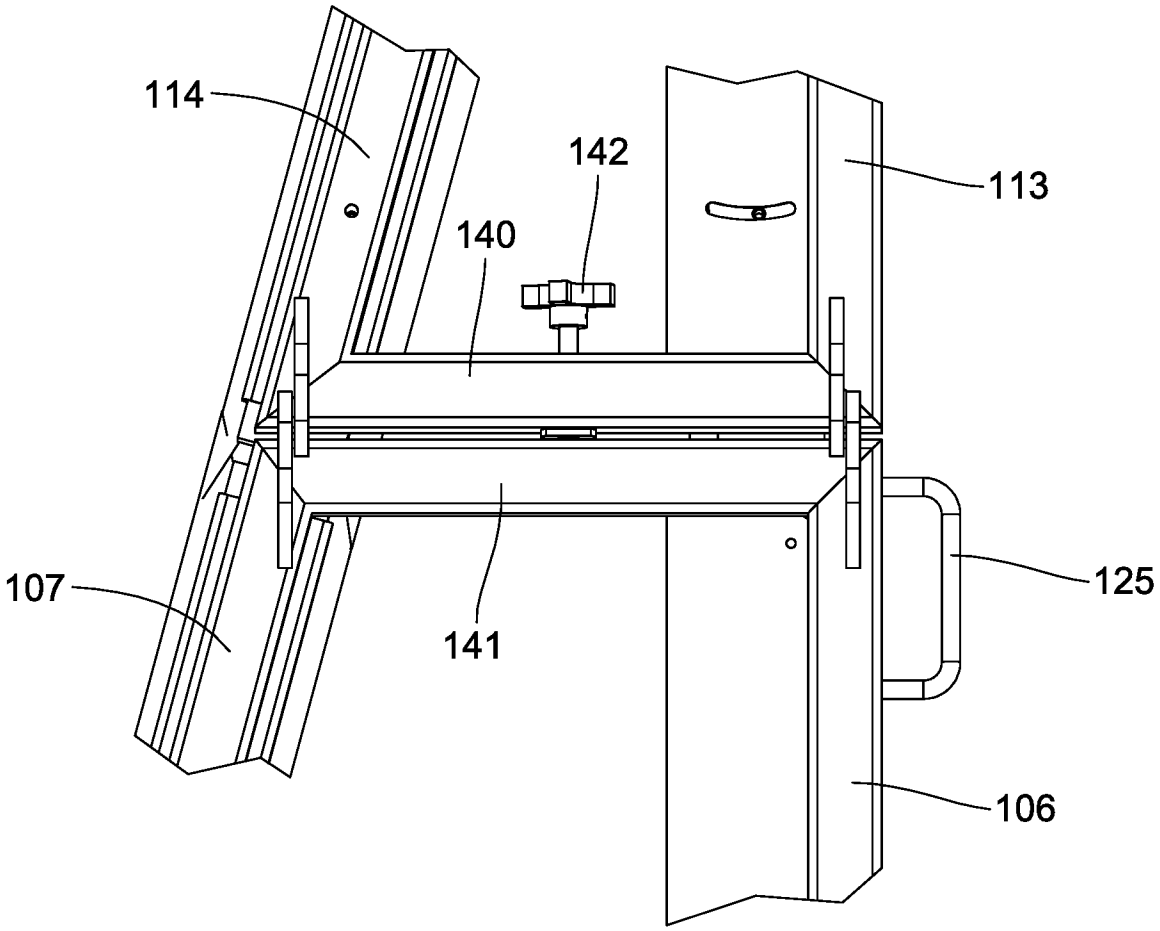
FIG. 6 is a fragmentary enlarged top view of one of the wings and associated brush with the distal end portion of the winged/brush positioned relative to the proximal end portion of the winged/brush by an adjustment screw.

Each wing 100-103 includes a manual adjustment screw rotatably mounted to the inner cross link of the outer portion of the wing with a screw distal end movable against the outer cross link of the inner portion of the wing to adjust the positioning of the outer wing portion to the inner wing portion. For example, wing 101 has a cross member 140 (FIG. 6) extending between and connected to the proximal ends of rails 113 and 114. Adjustment screw 142 is threadedly mounted to cross link 140 and has a distal end contactable against the outer cross link 141 extending between and connected to the distal ends of rails 106 and 107. In the event, the top road surface beneath brushes 120 and 121 is lower in elevation that the road surface beneath brushes 111 and 112 (FIG. 1), then adjustment screw 142 may be rotated until the outer brushes 120 and 121 drop lower in elevation than brushes 111 and 112 maintaining road surface contact with all of the brushes of wing 101.

Four adjustment jacks 150-153 (FIG. 1) are mounted inboard to frame 21 to provide easy transport of the device when the four wings 101-104 are in the upward stored position. Further, jacks 150-153 allow for the manual positioning of the frame relative to the road surface in order to allow for contact of the brushes on each side of the frame to maintain contact with the road surface. As the frame is pulled along an uneven surface, operators may walk along on both sides of the frame and manually adjust each jack to maintain the contact between the brushes and road surface.

Jack 150 will now be described, it being understood that a similar description applies to jacks 151-153. Jack 150 has a housing 158 (FIG. 3) mounted inward to frame 21 behind wheel 31. A crank 157 is operable when rotated to move a worm gear or rod 155 within housing 158 with the worm gear or rod 155 extending out of the bottom of casing 158 thereby raising or lowering a wheel 156 rotatably mounted to the bottom end of the worm gear or rod to engage the road surface. Alternatively, a shoe 161 may be mounted to the bottom of the worm gear as shown for jack 151. Any combination of wheels and shoes is used to allow the manual positioning of each side of the frame relative to the road surface and thus the contact between the brushes and the road surface.

Once the emulsion leveling device 20 is located atop the road, crank handle 85 is manually moved to rotate the worm gear 68 (FIG. 2) resulting in the vertical movement of the towbar assembly until towbar hitch plate 80 is positioned adjacent and connected to the hitch of the towing vehicle. Frame 21 remains horizontal atop the road as the towbar is moved angularly relative to the frame until the hitch plate 80 is adjacent the towing vehicle hitch. Wings 100-103 are lowered in place to locate the wing brushes atop the road. Once the towbar is connected to the towing vehicle, further rotation of worm gear 68 results in a further change in the angle between axes 28 and 48 (FIG. 3) thereby enabling the operator to level the frame relative to the ground. During movement of worm gear 68, the linear actuator 53 is locked in place and will not extend or retract.

With the worm gear 68 fixed in place, the linear actuator may be activated by transmitter 162 transmitting a signal to receiver 160 in turn activating actuator motor 166 to rotate the actuator worm gear causing extension or retraction of the actuator casing 56 (FIG. 1). Movement of the actuator results in pivoting movement of brackets 46 and 47 (FIG. 2) causing the axle to turn thereby raising wheels 30 and 31 to the upward stored position. During movement of the actuator, the manual worm gear 68 is fixed and does not extend or retract. Likewise, when the manual worm gear is extended or retracted, the actuator is fixed and does not extend or retract. As wheels 30 and 31 move upwardly, the various brushes contact the emulsion atop the road. The four jacks 150-153 are manually adjusted by workers walking to the side of frame 21 as the frame is pulled along the road. The handles on each jack enable the wheels/shoes located at the bottom of each jack to contact the road surface which may be lower than the crown of the road. Likewise, the adjustment screws 140 may be adjusted in the event there is a difference in elevation between the road and the brushes in each wing.

Figure 7:
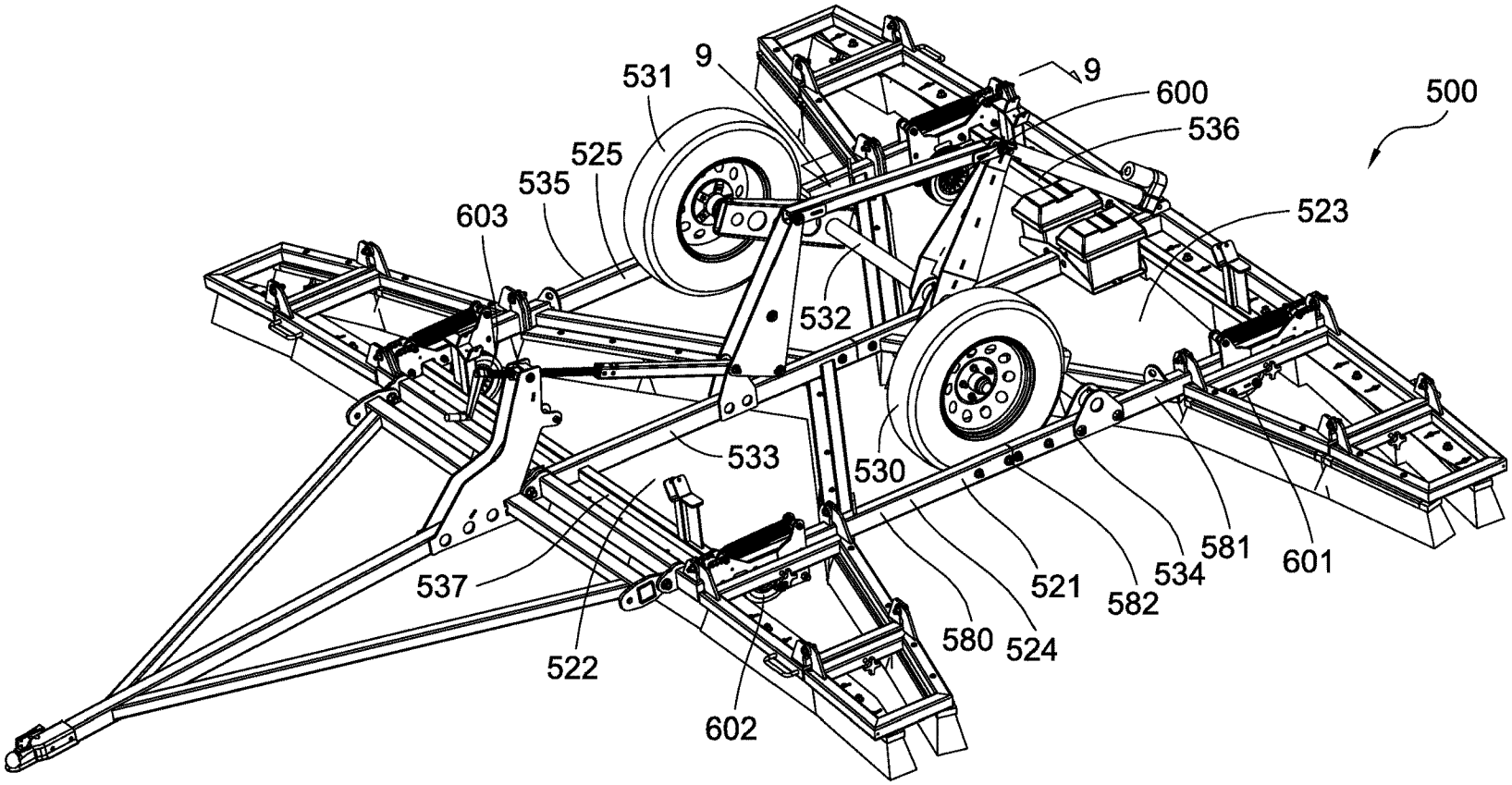
FIG. 7 is a front perspective view of the spreading and leveling device incorporating the preferred embodiment of the present invention with the main wheels in the upward stored position.
Figure 8:
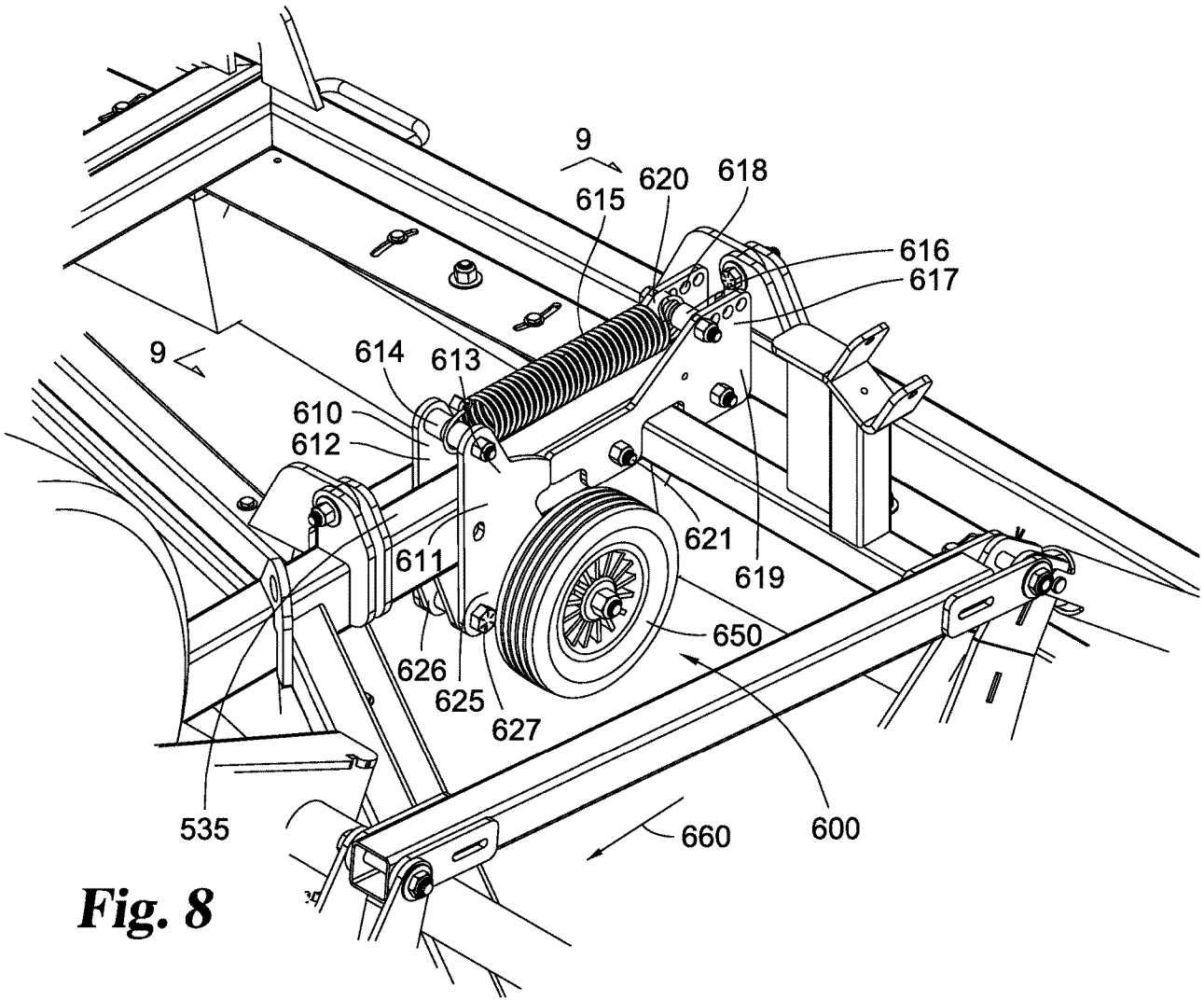
FIG. 8 is a fragmentary and enlarged top perspective view of the device of FIG. 7 and one of the guide wheels mounted to the device frame.
Figure 9:
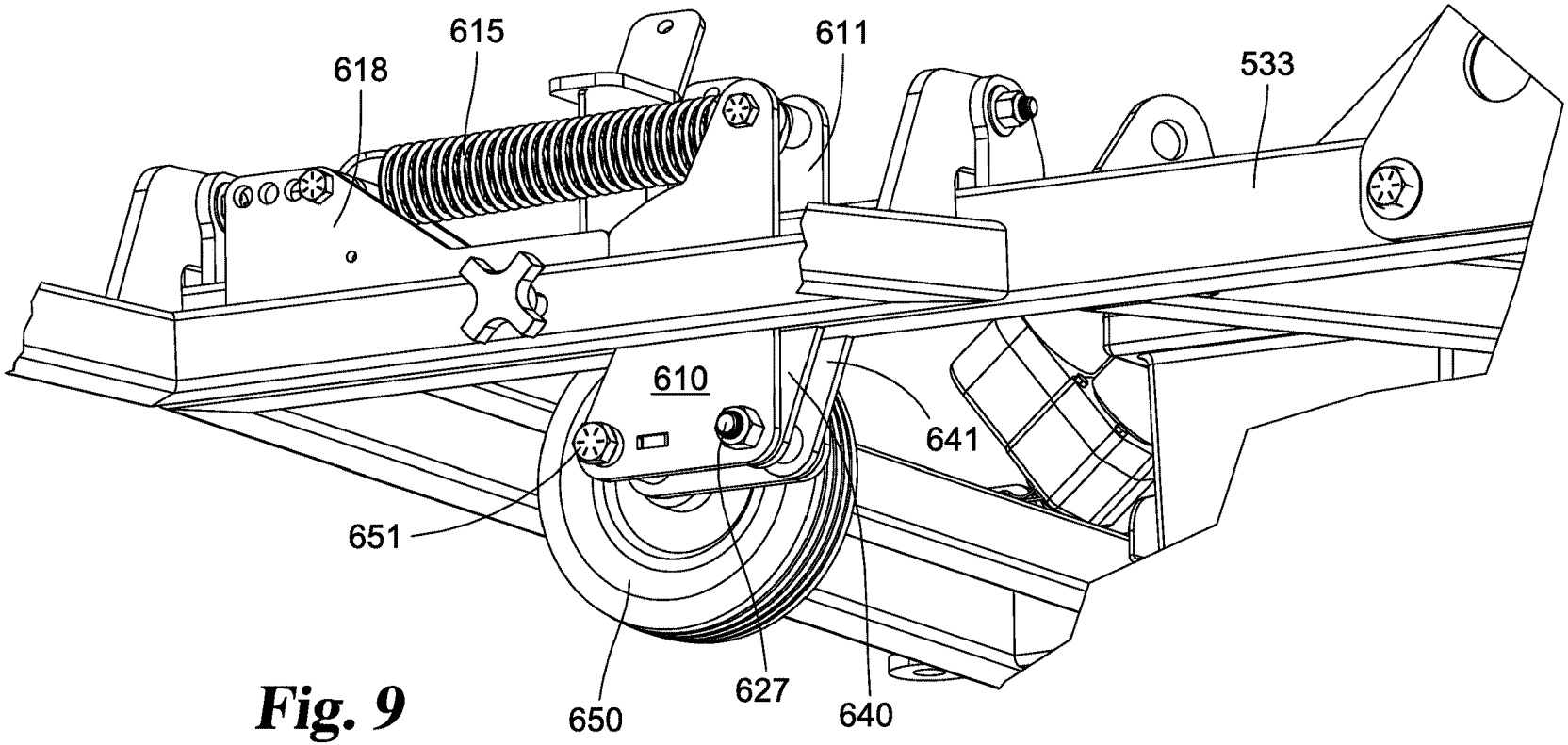
FIG. 9 is a fragmentary and enlarged bottom view looking in the direction of arrows 9-9 of FIG. 8 of the device showing the guide wheel 650 and with the brushes removed for purposes of clarity.

The preferred embodiment of the present invention is shown in FIGS. 7-9. The device 500 (FIG. 7) is used for spreading and leveling emulsion applied to a road surface. Device 500 is identical to the device 20 previously shown and described herein with the exception that guide wheels are mounted to the outer extremities of the rectangular frame 521 and with the further exception that the main frame 21 may be disassembled for transportation. Thus, device 500 includes a rectangular frame having a front portion 522 and a rear portion 523 along with a pair of parallel sides 524 and 525. The frame includes side rails 534 and 535 having opposite ends attached to the front rail assembly 537 and the rear assembly 536. The towbar assembly is pivotally mounted to the front end portion 522 as previously described and utilized for the alternate embodiment. The plurality of bushes extend downwardly from the frame to engage the emulsion atop the load surface in the identical manner as previously described of the alternate embodiment. Wheels 530 and 531 are rotatably mounted to brackets, in turn, fixedly secured to axle 532 rotatably mounted to central rail 533 having its opposite ends connected to the frame. The wheels operate in the same manner as previously described.

The preferred embodiment of the device is shown in FIGS. 7-9. Device 500 has the added feature of four guide wheel assemblies 600-603 mounted to the opposite sides of the rectangular frame. Guide wheel assembly 601 and 602 are mounted inwardly to and adjacent side rail 534 whereas guide wheel assembly 600 and 603 are mounted inwardly and adjacent side rail 535. The guide wheel assemblies are designed to operate independent of the jacks 150-153 (FIG. 1). That is, device 500 includes the four guide wheel assemblies and may or may not include the four jacks.

Guide wheel assembly 600 (FIG. 8) will now be described it being understood that a similar description applies to the remaining guide wheel assemblies 601-603. Assembly 600 includes a pair of brackets 610 and 611 having top ends 612 and 613 connected together by fastener 614 with a helical spring 615 mounted thereto. One end of the helical spring is mounted to fastener 614 whereas the opposite end is mounted to fastener 616 which secures together the top ends 617 and 618 of brackets 619 and 620 mounted by fasteners 621 to side rail 535. Side rail 535 extends between brackets 610 and 611 and further between brackets 619 and 620. The bottom ends 625 and 626 of brackets 611 and 610 are secured together by a conventional fastener 627. Flanges 640 and 641 (FIG. 9) have their top ends mounted to the bottom of side rail 535 and bottom ends through which fastener 627 extends. Brackets 610 and 611 are pivotally mounted by fastener 627 to flanges 640 and 641.

Wheel 650 (FIG. 9) is rotatably mounted via axle 651, in turn, mounted to brackets 610 and 611. Thus, wheel 650 rotates about axle 651 independent of the pivotal motion of brackets 610 and 611 about fastener 627. The axis of rotation of wheel 650 extending through axle 651 is offset from the pivot axis of the wheel assembly extending through fastener 627. Various structure including the brushes have been removed from FIG. 9 for illustration purposes only to show the mounting of the wheel assembly. Spring 620 is operable to urge wheel 650 in the forward direction of arrow 660 but is yieldable to allow wheel 650 to move in a direction opposite of arrow 660 (FIG. 8). Thus, in the event the wheel encounters a rock or other object protruding from the road surface, the wheel may pivot toward the rear of the vehicle with the wheel eventually being urged in the forward direction of arrow 660. The wheel is therefore spring biased.

Device 500 is towed in a forward direction 660 (FIG. 8). In the event the main wheels 530 and 531 (FIG. 7) are in the completely down position, the various brushes are spaced upwardly apart from the road surface. Simultaneously, the four guide wheels 600-603 are in the down position engaging the road surface and guiding the device in the direction of forward movement of the towing vehicle. The guide wheels minimize any drift of the device from the longitudinal axis of movement that may be caused by the crown of the road. As the main wheels 530 and 531 are moved in an upward direction, the brushes will contact the road surface. Likewise, guide wheels 600-603 may move upwardly with spring 615 yielding while maintaining contact with the road surface and guiding the device along the road minimizing the weight of the device including the frame and various members upon the downwardly extending brushes. The guide wheels therefore not only guide the device on a straight line but also reduce the amount of downward force exerted by the brushes onto the road surface caused by the weight of the overall device. The helical springs included in the guide rule assemblies urge the guide wheels to maintain contact with the road surface particularly when the brushes are in contact with the road surface.

The rectangular frame 521 is designed to be quickly disassembled since the two side rails 534 and 535 including the center rail 533 (FIG. 7) are each composed of a pair of rails having adjacent ends removably secured together. That is, side rail 534 includes a pair of component rails 580 and 581 having their adjacent ends connected together at junction 582 by means of an inner rod extending into the hollow interior of each component rail 580 and 581 and then secured thereto by means of removable fasteners. The front end of rail 580 and the back end of rail 581 are secured respectively to the front portion and back portion of the frame. Likewise, center rail 533 and side rail 535 each include a pair of component rails with adjacent ends removably secured together in the same manner as described for component rails 580 and 581. As a result, side rails 534 and 535 along with center rail 533 may be disassembled into their component rails to allow for separation of the back portion 523 of the frame from the front portion 522 of the frame. Minimal disassembly of the mechanism for raising and lowering the main wheels 530 and 531 is required thereby completely separating the front end portion of the machine from the rear end portion of the machine.

While the invention has been illustrated and described in detail in the drawings and foregoing description, the same is to be considered as illustrative and not restrictive in character, it being understood that only the preferred and alternate embodiments have been shown and described and that all changes and modifications that come within the spirit of the invention are desired to be protected.

What is claimed is:

1. A device for spreading and leveling emulsion applied to a surface of a road having a crown comprising:

a frame having a longitudinal axis of movement, a forward portion, a back portion, and opposite sides extending therebetween;

a towbar pivotally mounted to said forward portion of said frame;

a plurality of brushes mounted to said frame and extending transversely across said axis of movement and extending downward to spread and level emulsion applied to a road surface;

a pair of main wheels mounted to said frame with said axis extending therebetween, said main wheels having an upward stored position and a downward road engaging position;

a plurality of a spring biased guide wheels rotatable mounted to said frame and located on said opposite sides to support said opposite sides and guide the device on a road having a crown, said guide wheels contacting the road surface when said main wheels are in said upward stored position;

a first mechanism connected to said towbar to pivot said towbar; and, a second mechanism mounted on said frame and connected to said main wheels for moving said main wheels to said stored position with said brushes engaging the road surface and to said road engaging position positioning said brushes apart from the road surface.

2. The device of claim 1 and further comprising:

a plurality of springs positioned between said frame and said guide wheels with said springs urging said guide wheels to maintain contact with the road surface when said brushes are in contact with the road surface.

3. The device of claim 2 wherein:

said springs urging said guide wheels against the road surface supporting the frame thereon and minimizing frame weight on said brushes.

4. The device of claim 3 and further comprising:

a plurality of brackets movably mounted to said frame and having said guide wheels rotatably mounted thereto; and wherein:

said frame includes side rails extending between said forward portion and said back portion, said brackets have pivot portions pivotably mounted to said side rails at said forward portion and said back portion of said frame with said guide wheels mounted offset relative to said pivot portions.

5. The device of claim 4 wherein:

said side rails each include first rails and second rails aligned when assembled but separable when disassembled to facilitate positioning said back portion of said frame apart from said forward portion of said frame for transportation thereof.

6. A machine to level a fluid disposed on a road, and connectable to a hitch of a pulling vehicle comprising:

a frame with weight;

brushes mounted to said frame and extending downwardly therefrom;

a main wheel rotatably mounted to said frame and movable from an upward stored position with said brushes contacting a surface and a downward position with said brushes spaced apart from the surface;

a towbar pivotably mounted to said frame for pulling said frame across the surface;

guide wheels rotatably mounted to said frame and located outwardly of said main wheel, said guide wheels contacting said surface guiding movement of the machine; and, springs urging said guide wheels downwardly to contact said surface reducing said weight of said frame applied to said brushes.

7. The machine of claim 6 and further comprising:

brackets pivotably mounted to said frame and having said guide wheels rotatably mounted thereto, said brackets have top portions connected to said springs which are also connected to said frame urging said brackets to pivot to urge said guide wheels to contact said surface.

8. The machine of claim 7 and further comprising:

a first mechanism connected to said frame and said towbar for pivoting said towbar upwardly to align said towbar with the hitch of a pulling vehicle; and, a second mechanism mounted to said frame and connected to said main wheel moving said main wheel upwardly to said stored position.

9. An emulsion smoothing machine connectable to a pulling vehicle comprising:

a frame connectable to a vehicle for movement along a forwardly extending axis of movement, said frame having a front portion and a back portion;

brushes mounted to said frame and contactable with a surface;

main wheels rotatably mounted to said frame;

guide wheels rotatably mounted to said frame outwardly of said main wheels to direct said frame to move along said axis of movement;

a mechanism to raise and lower said main wheels; and, wheel assemblies having said guide wheels rotatably mounted thereto with said assemblies movably mounted to said frame and including springs to urge said guide wheels downwardly against the surface.

10. The machine of claim 9 wherein said guide wheels are located in said front portion and said back portion of said frame.

11. The machine of claim 9 said wheel assemblies are pivotably mounted to said frame with said springs urging said guide wheels to pivot downwardly but yieldable to allow said wheel assemblies to pivot upwardly.

12. The machine of claim 10 and further comprising:

a mechanism mounted to said frame and connected to said main wheel moving said main wheel upwardly to a stored position.

* * * * *